US007541127B2

(12) United States Patent
Ieda

(10) Patent No.: US 7,541,127 B2
(45) Date of Patent: Jun. 2, 2009

(54) TONER FOR DEVELOPING ELECTROSTATIC IMAGE

(75) Inventor: Osamu Ieda, Tokyo (JP)

(73) Assignee: Zeon Corporation, Tokyo (JP)

( * ) Notice: Subject to any disclaimer, the term of this patent is extended or adjusted under 35 U.S.C. 154(b) by 242 days.

(21) Appl. No.: 11/589,845

(22) Filed: Oct. 31, 2006

(65) Prior Publication Data

US 2007/0099102 A1 May 3, 2007

(30) Foreign Application Priority Data

Oct. 31, 2005 (JP) ..... 2005-317360

(51) Int. Cl.
*G03G 9/08* (2006.01)

(52) U.S. Cl. ..... 430/108.1; 430/110.3; 430/111.4

(58) Field of Classification Search ..... 430/108.1, 430/110.3, 111.4
See application file for complete search history.

(56) References Cited

U.S. PATENT DOCUMENTS 6,649,315 B1 * 11/2003 Takasaki ..... 430/110.3
7,422,833 B2 * 9/2008 Niwa et al. ..... 430/107.1
2004/0143036 A1 * 7/2004 Takano et al. ..... 523/216
2005/0058924 A1 * 3/2005 Miyakawa ..... 430/108.6
2006/0154163 A1 * 7/2006 Kidokoro ..... 430/108.22

FOREIGN PATENT DOCUMENTS

| | | |
|---|---|---|
| JP | 2003-295498 | 10/2003 |
| JP | 2003-330218 | 11/2003 |
| JP | 2004-177747 | 6/2004 |
| JP | 2005-10723 | 1/2005 |

* cited by examiner

*Primary Examiner*—John L Goodrow
(74) *Attorney, Agent, or Firm*—Westerman, Hattori, Daniels & Adrian, LLP.

(57) ABSTRACT

The present invention aims to provide a toner for developing electrostatic image which is excellent in image reproducibility and further in cleaning performance. A toner for developing electrostatic image comprising a colored particle containing a binder resin and a colorant, and an external additive, wherein the toner for developing electrostatic image has a volume average particle diameter of 4.0 to 8.0 μm and an average circularity of 0.940 to 0.980, and wherein the toner for developing electrostatic image has a uniaxial collapsing stress of 0.8 to 1.5 kPa and an internal frictional angle of 30 to 45° when a maximum consolidation stress is 0.

9 Claims, 2 Drawing Sheets

TONER FOR DEVELOPING ELECTROSTATIC IMAGE

BACKGROUND OF THE INVENTION

1. Field of the Invention

The present invention relates to a toner for developing electrostatic image (hereinafter, "a toner for developing electrostatic image" may be simply referred to as "a toner") used for development of electrostatic image or the like in an electrophotography, an electrostatic recording method, an electrostatic printing process or the like.

2. Description of the Related Art

A method of forming desired images by developing electrostatic image with a toner is widely used.

For example, in an electrophotography, a latent image of electrostatics formed on a photosensitive member is developed by a toner comprising a colored particle and an external additive so as to obtain a toner image, and the toner image is transferred to a transferring material such as paper, an OHP sheet or the like. Then, the toner image is fixed on the transferring material, and thus obtained a printed product.

The need of colorization for image-forming devices employing the electrophotography such as copying machines, facsimiles, printers or the like is increasing. In a full-color electrophotography, color image forming generally uses 3 color toners such as yellow, magenta and cyan or 4 color toners such as yellow, magenta, cyan and black to reproduce colors. An example of the image forming method in the case of color copying is as follows. Firstly, a color image is scanned by being broken into pixels and digital image signals by color are sent to a light radiation device. Light is radiated on a surface of a charged photosensitive member from the light radiation device to form a latent image of electrostatics. Next, the latent image of electrostatics is developed by color toners which correspond to the latent image of electrostatics by color on the photosensitive member and finally transferred to a transferring material such as paper, an OHP sheet or the like.

On the other hand, the toner remaining on the photosensitive member after the transferring process (hereinafter, it may be referred to as "a remaining toner") is removed through the cleaning process by means of a cleaning device such as a cleaning blade or the like.

Generally, toners used for development are broadly classified into a toner produced by a pulverizing method or a toner produced by a polymerization method.

The pulverizing method is a method of producing a colored particle by pulverizing and classifying a solid of a colored resin obtained by a method of dissolving, mixing and kneading a binder and a colorant or a method of polymerizing a mixture containing a monomer and a colorant.

On the other hand, as the polymerization method, for example, there may be a suspension polymerization method, wherein a droplet of a polymerizable monomer composition containing a polymerizable monomer and a colorant is formed and the droplet is polymerized so as to produce a colored particle, or the like. While the colored particle obtained by the pulverizing method is amorphous, the colored particle obtained by the polymerization method is close to a spherical shape and has a small particle diameter and a sharp particle size distribution.

Particularly, from the viewpoint of improving an image quality such as image reproducibility, fineness or the like, a toner whose shape and particle diameter distribution are highly controlled such as the toner obtained by the polymerization method (a so-called polymerized toner) has been used.

However, when using a toner having a small particle diameter or a toner having a spherical shape, a remaining toner is likely to pass between the photosensitive member and the cleaning blade in the cleaning process. Hence, a cleaning problem that the remaining toner may remain on the photosensitive member after the cleaning process is likely to occur, thereby, filming of the remaining toner on the photosensitive member may occur by continuous image forming and the remaining toner may cause insufficient charging on the surface of the photosensitive member, poor latent image forming, decrease in charge amount of the toner, fogging and so on.

Therefore, development of a toner which is excellent in high image reproducibility and further in cleaning performance is desired.

Japanese Patent Application Laid-Open (JP-A) No. 2005-010723 aims to provide a toner which can be easily cleaned without decreasing reproducibility of thin lines due to toner scattering, and discloses a method of producing a toner for developing electrostatic image, wherein an organic solvent is removed while applying shear stress to an emulsified dispersion liquid of a toner composition. Meanwhile, JP-A No. 2005-010723 discloses that the toner manufactured by the above method has a spindle form and 3 to 8 μm volume average particle diameter.

However, the toner disclosed in JP-A No. 2005-010723 may not be sufficient for reproducibility of thin lines and cleaning performance.

On the other hand, toner flowability is being considered in order to improve characteristics of a toner other than reproducibility of thin lines and cleaning performance mentioned above.

JP-A No. 2003-295498 discloses a toner comprising a coloring particle and an external addictive, wherein an angle of repose of the toner is 15 to 30° and a looseness apparent specific gravity thereof is 0.40 to 0.45 g/cc. Also, JP-A No. 2003-295498 mentions a toner containing a silica microparticle having a volume average particle diameter of a primary particle of 5 to 18 μm and a microparticle having a volume average particle diameter of a primary particle of 0.1 to 1.0 μm as an external additive.

JP-A No. 2004-177747 discloses a toner for developing a latent image of electrostatics comprising an external additive including a silica coated metal oxide particle having a core-shell structure and a silica microparticle having a volume average particle diameter of 5 to 20 nm, and a colored particle.

JP-A No. 2003-330218 discloses in claims a toner having a uniaxial collapsing stress of 50 G [N/m$^2$] (equivalent to 0.5 kPa/g; G means gravity acceleration) or less in order to prevent clogging of the toner in an image forming device transferring the toner by means of an air pump. However, a composition and a production method of the toner are not disclosed in JP-A No. 2003-330218.

The toners mentioned in the above priority arts do not basically consider reproducibility of thin lines and cleaning performance.

The present invention has been achieved in light of the above-stated circumstances. An object of the present invention is to provide a toner which is excellent in image reproductivity and further in cleaning performance.

SUMMARY OF THE INVENTION

As the result of diligent researches made to attain the above object, the inventor of the present invention found out that the above object can be attained by controlling a uniaxial collapsing stress, an internal frictional angle and an average circularity of the toner having a small particle diameter within the specified ranges which are different from those of the conventional art.

The present invention is based on the above knowledge and provides a toner for developing electrostatic image comprising a colored particle containing a binder resin and a colorant, and an external additive, wherein the toner for developing electrostatic image has a volume average particle diameter of 4.0 to 8.0 μm and an average circularity of 0.940 to 0.980, and wherein the toner has a uniaxial collapsing stress of 0.8 to 1.5 kPa and an internal frictional angle of 30 to 45° when a maximum consolidation stress is 0.

Generally, a toner having a small particle diameter is used to improve image quality of a toner such as reproductivity of thin lines and so on. However, a spherical toner having a small particle diameter cannot be fully removed in a cleaning process using a cleaning blade and remained on a photosensitive member.

To the contrary, since the present invention specifies the average circularity of the toner having a small particle diameter so that the toner is not absolutely spherical, and further uses a specific external additive or the like, the uniaxial collapsing stress and the internal frictional angle are controlled, thereby, a toner for developing electrostatic image which is excellent in reproductivity of thin lines and cleaning performance can be obtained.

An absolute value of a charge amount |Q/M| of the toner for developing electrostatic image of the present invention is preferably from 30 to 120 μC/g.

The toner for developing electrostatic image of the present invention may preferably contain an inorganic microparticle (A) having a small particle diameter, a number average primary particle diameter of which is from 5 to 14 nm, as the external additive from the viewpoint of flowability of the toner.

Since a hydrophobicity measured by a methanol method of the inorganic microparticle (A) having a small particle diameter is from 50 to 100%, decrease in a charge amount of the toner particularly under an environment of a high-temperature and a high-humidity can be prevented.

Also, the toner for developing electrostatic image of the present invention may preferably contain an inorganic microparticle (B) having a medium particle diameter, a number average primary particle diameter of which is from 15 to 90 nm, as the external additive so as to obtain excellent cleaning performance and reproductivity of thin lines.

Since a hydrophobicity measured by a methanol method of the inorganic microparticle (B) having a medium particle diameter is from 50 to 100%, decrease in a charge amount of the toner particularly under an environment of a high-temperature and a high-humidity can be prevented.

From the viewpoint of cleaning performance, the toner for developing electrostatic image of the present invention may preferably contain a particle (C) having a large particle diameter, a number average primary particle diameter of which is from 100 to 500 nm, as the external additive.

An added amount of the external additive in the present invention is preferably from 0.01 to 3 parts by weight with respect to the colored particle of 100 parts by weight.

The above-mentioned toner for developing electrostatic image of the present invention is excellent in reproductivity of thin lines and cleaning performance, hence, the toner can form high quality images with high image density.

BRIEF DESCRIPTION OF THE DRAWINGS

In the accompanying graphs and drawings.

The numerical symbol in each figure refers to the following: 1: photosensitive drum; 2: charging roller; 3: light radiation device; 4: development device; 5: transfer roller; 6: cleaning blade; 7: fixing device; 7*a*: heating roller; 7*b*: support roller; 8: casing; 8*a*: toner vessel; 9: developing roller; 10: blade for the developing roller; 11: supply roller; 12: stirring vane; 13: toner; and 14: transferring material

DETAILED DESCRIPTION OF THE INVENTION

A toner for developing electrostatic image of the present invention is a toner comprising a colored particle containing a binder resin and a colorant, and an external additive, wherein the toner for developing electrostatic image has a volume average particle diameter of 4.0 to 8.0 μm and an average circularity of 0.940 to 0.980, and wherein the toner has a uniaxial collapsing stress of 0.8 to 1.5 kPa and an internal frictional angle of 30 to 45° when a maximum consolidation stress is 0.

The toner for developing electrostatic image of the present invention mainly comprises a colored particle having a small particle diameter. By specifying the average circularity so that the toner is not absolutely spherical and further using the external additive and so on, the uniaxial collapsing stress mainly relating to cohesion (or an adhesive property) of the toner and the internal frictional angle mainly relating to flowability of the toner are controlled. Thereby, the toner for developing electrostatic image of the present invention is excellent in reproductivity of thin lines and cleaning performance.

Figure 1:
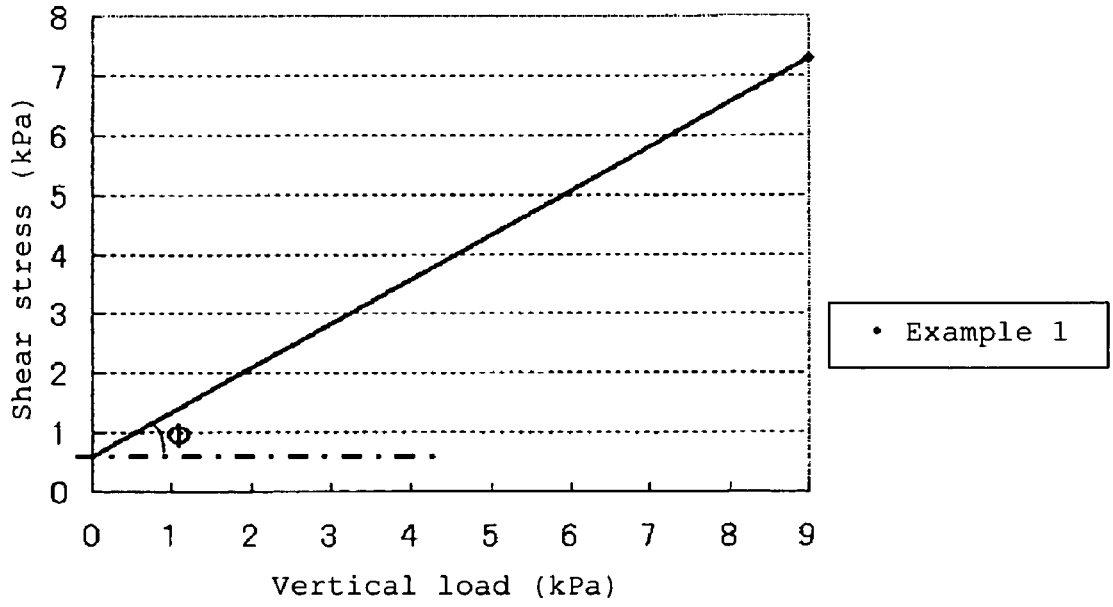
FIG. 1 is a graph showing a primary line (failure envelope) derived from a relationship of shear stress and vertical load.

In the present invention, the internal frictional angle is defined by an amount of fluctuation of shear stress per unit vertical load and represented by $\phi$, which is a gradient in a graph of a primary line (failure envelope) of a shear stress and a consolidation load as shown in FIG. 1. The internal frictional angle can be an indicator to present flowability of a toner taking account of a load.

The internal frictional angle of the toner of the present invention is preferably from 30 to 45°, more preferably from 32 to 43°.

If the internal frictional angle exceeds the above range, flowability of the toner lower so that the toner in a toner vessel is agitated insufficiently by means of a stirring vane or the like. Thus, an initial charge speed may decline.

On the other hand, if the internal frictional angle is less than the above range, flowability of the toner becomes so high that cleaning performance declines. Thus, filming, fogging and so on may be generated.

Figure 2:
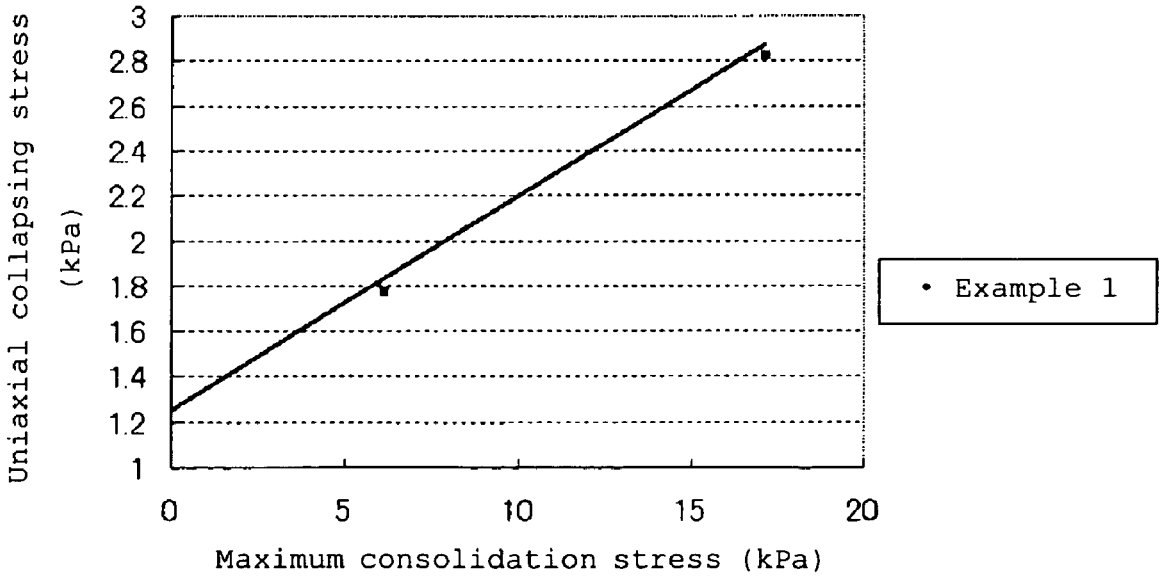
FIG. 2 is a graph showing a primary line derived from a relationship of a uniaxial collapsing stress and a maximum consolidation stress.

The uniaxial collapsing stress is a shear stress which enables to start flowing powders of a powder layer (a toner layer in the present invention) under a maximum consolidation stress and can be represented by Formula (1) mentioned below. In the present invention, a uniaxial collapsing stress when a maximum consolidation stress becomes 0 in a graph of a uniaxial collapsing stress and a maximum consolidation stress as shown in FIG. 2. is considered as the uniaxial collapsing stress of the present invention. The uniaxial collapsing stress can be an indicator to present cohesion (or an adhesive property) of a toner.

The uniaxial collapsing stress of the toner of the present invention is preferably from 0.8 to 1.5 kPa, most preferably from 0.9 to 1.4 kPa.

If the uniaxial collapsing stress exceeds the above range, cohesion between toner particles increases so that a lack of fragments of an image may be easily generated. Thus, reproductivity of thin lines may decline.

On the other hand, if the uniaxial collapsing stress is less than the above range, a force of interaction between toner particles becomes weak. Thus, character scattering wherein a toner particle is dispersed and attached around an original dot may be generated.

Herein, the maximum consolidation stress is a vertical load which is required to enable a powder aggregate (a toner aggregate in the present invention) to be a powder layer (a toner layer in the present invention), and can be represented by Formula (2) mentioned below.

$$\text{uniaxial collapsing stress} = \frac{2c(1+\sin\phi)}{\cos\phi} \quad (1)$$

$$\text{maximum consolidation stress} = \left(\frac{A-\sqrt{A^2\sin^2\phi-\tau_{ssp}^2\cos^2\phi}}{\cos^2\phi}\right)(1+\sin\phi)-\left(\frac{c}{\tan\phi}\right) \quad (2)$$

$A=\sigma_{ssp}+(c/\tan\phi)$ c=cohesion (kPa) $\phi$=internal frictional angle (°)

$\tau_{ssp}$=shear stress required to obtain stationary state point (kPa)

$\sigma_{ssp}$=vertical load required to obtain stationary state point (kPa)

An absolute value of a charge amount |Q/M| of the toner of the present invention is preferably from 30 to 120 μC/g, more preferably from 50 to 110 μC/g.

The charge amount of the toner Q/M is a charge amount of unit weight of a toner.

The charge amount of the toner can be measured, for example, in such a manner that a carrier and a toner are agitated and subject to blowing off by means of a blowoff meter, and then a charge amount (μC/g) of the toner is measured by means of a suction type Q/m analyzer (product name: 210HS-2A; manufactured by Trek Japan KK.).

Hereinafter, component materials and production method of the toner of the present invention will be explained in detail.

The toner of the present invention contains a colored particle and an external additive attached on the surface of the colored particle. The toner may contain other particles or components such as a carrier which is a particle to support the colored particle or the like, if required.

The colored particle in the toner contains at least a binder resin and a colorant, and may contain other components such as a charge control agent, a release agent or the like, if necessary.

As the binder resin to be contained in the colored particle, resins which are conventionally used as binder resins of a toner can be used. For example, there may be styrene such as polystyrene, polyvinyl toluene or the like and a substitution polymer thereof; a styrene copolymer such as a styrene-methyl acrylate copolymer, a styrene-butyl acrylate copolymer, a styrene-2-ethylhexyl acrylate copolymer, a styrene-methyl methacrylate copolymer, a styrene-ethyl methacrylate copolymer, a styrene-butyl methacrylate copolymer, a styrene-butadiene copolymer or the like; polymethyl methacrylate, polyester, an epoxy resin, polyvinyl butyral, an aliphatic or alicyclic hydrocarbon resin, polyolefin, a (meth)acrylate resin, a norbornene resin, a hydrogenated product of the above-mentioned styrene based resin, or the like.

As the colorant, various pigments and dyes which are generally used for a toner can be used. To obtain a monochrome toner, for example, carbon black, titan black or the like may be used as a black colorant.

To obtain a full-color toner including a yellow toner, a magenta toner and a cyan toner, a yellow colorant, a magenta colorant and a cyan colorant may be respectively used.

As the yellow colorant, for example, a compound such as an azo based pigment, a condensed polycyclic based pigment or the like can be used. Specifically, there may be C. I. Pigment Yellow 3, 12, 13, 14, 15, 17, 62, 65, 73, 74, 75, 83, 90, 93, 97, 120, 138, 155, 180, 181, 185, 186 or the like.

As the magenta colorant, for example, a compound such as an azo based pigment, a condensed polycyclic based pigment or the like can be used. Specifically, there may be C. I. Pigment Red 31, 48, 57, 58, 60, 63, 64, 68, 81, 83, 87, 88, 89, 90, 112, 114, 122, 123, 144, 146, 149, 150, 163, 170, 184, 185, 187, 202, 206, 207, 209 or 251, C. I. Pigment Violet 19 or the like.

As the cyan colorant, for example, a phthalocyanine compound such as a copper phthalocyanine compound or the like and the derivative thereof, an anthraquinone compound or the like can be used. Specifically, there may be C. I. Pigment Blue 2, 3, 6, 15, 15:1, 15:2, 15:3, 15:4, 16, 17, 60 or the like.

An amount of the colorant is preferably from 1 to 10 parts by weight with respect to the binder resin of 100 parts by weight.

The colored particle preferably contains the charge control agent. As the charge control agent, charge control agents which are conventionally used for a toner can be used without limit. Charge control agents are classified into a charge control agent having a negatively charging ability and a charge control agent having a positively charging ability. The charge control agent of the present invention is selected depending on whether a toner is to have a negatively charging ability or to have a positively charging ability.

Among the charge control agents, a charge control resin may be preferably used. The charge control resin has high compatibility with a binder resin and has no color. By using the charge control resin, a toner having a stable charge property even in high-speed color continuous printing can be obtained.

Hereinafter, a charge control resin having a negatively charging ability and a charge control resin having a positively charging ability will be explained.

As the charge control resin having a negatively charging ability, there may be a resin which has a substituent selected from a group consisting of a carboxyl group or the salt thereof, a phenol group or the salt thereof, a thiophenol group or the salt thereof and a sulfonic acid group or the salt thereof in a polymer side chain, or the like.

Among them, the resin having a sulfonic acid group or the salt thereof in a polymer side chain is preferably used. Specifically, there may be a resin obtained by copolymerization of a monovinyl monomer containing a sulfonic acid group or the salt thereof and other monovinyl monomers which is copolymerizable with the monovinyl monomer.

As a monovinyl monomer containing a sulfonic acid group or the salt thereof, for example, there may be styrenesulfonate, sodium styrenesulfonate, potassium styrenesulfonate, 2-acrylamide-2-methylpropanesulfonate, sodium vinyl sulfonate, ammonium methacryl sulfonate or the like.

As other monovinyl monomers which are copolymerizable with the monovinyl monomer containing the sulfonic acid group or the salt thereof, there may be an ethylenically unsaturated carboxylic acid ester monomer, an aromatic vinyl monomer, an ethylenically unsaturated nitrile monomer or the like.

A compounding amount of the monovinyl monomer containing a sulfonic acid group or the salt thereof in the whole amount of monomers constituting the charge control resin having a negatively charging ability is preferably from 0.5 to 15 wt %, more preferably from 1 to 10 wt %. If the compounding amount of the monovinyl monomer containing a sulfonic acid group or the salt thereof is less than the above range, a charge amount of the toner may become insufficient. If the compounding amount of the monovinyl monomer containing a sulfonic acid group or the salt thereof exceeds the above range, an increase in a charge amount of the toner at a low temperature and a low humidity becomes large so that printing soiling can be generated.

As the charge control resin having a negatively charging ability, a charge control resin having a negatively charging ability having a weight average molecular weight of 2,000 to 50,000 may be preferable, more preferably from 4,000 to 40,000, and most preferably from 6,000 to 35,000.

A glass transition temperature of the charge control resin having a negatively charging ability is preferably from 40 to 80° C., more preferably from 45 to 75° C., and most preferably from 45 to 70° C. If the glass transition temperature is less than the above range, shelf stability of a toner may decrease. If the glass transition temperature exceeds the above range, fixing ability may lower.

As the charge control resin having a positively charging ability, for example, there may be a resin containing an amino group such as $—NH_2$, $—NHCH_3$, $—N(CH_3)_2$, $—NHC_2H_5$, $—N(C_2H_5)_2$, $—NHC_2H_4OH$ or the like, and a resin containing a functional group including an ammonium chloridized amino group. Such a resin can be obtained by, for example, copolymerization of a monovinyl monomer containing an amino group and a monovinyl monomer which is copolymerizable therewith. Also, the resin can be obtained by ammonium chloridizing the copolymer obtained by the above method. Further, the resin can be obtained by copolymerization of a monovinyl monomer containing an ammonium salt group and a monovinyl monomer which is copolymerizable therewith. However, the method of obtaining such a resin is not limited thereto. As the monovinyl monomer which is copolymerizable with a monovinyl monomer containing an amino group or the monovinyl monomer which is copolymerizable with a monovinyl monomer containing an ammonium salt group, there may be the monovinyl monomer used to obtain a the charge control resin having a negatively charging ability.

As the monovinyl monomer containing the amino group, for example, there may be an (meth)acrylamide based monomer such as (meth)acrylamide, N-methyl (meth)acrylamide, N,N-dimethyl (meth)acrylamide, N-ethyl (meth)acrylamide or the like; a (meth)acrylic acid based derivative such as 3-(dimethylamino)propyl (meth)acrylate or the like; allylamine ; a styrene based derivative such as 2-aminostyrene, 4-aminostyrene or the like; and so on.

As an ammoniating agent used for ammonium chloridization of a copolymer, an agent which is generally used may be used such as alkyl halide including methyl iodide, ethyl iodide, methyl bromide, ethyl bromide or the like; alkyl ester of p-toluenesulfonic acid such as methyl p-toluenesulfonate, ethyl p-toluenesulfonate, propyl p-toluenesulfonate or the like; and so on.

A compounding amount of the monovinyl monomer having a functional group such as an amino group, an ammonium salt group or the like in the whole amount of monomers constituting the charge control resin having a positively charging ability is preferably from 0.5 to 15 wt %, more preferably from 1 to 10 wt %. If the compounding amount of the monovinyl monomer having the functional group is less than the above range, a charge amount of a toner may become insufficient. If the compounding amount of the monovinyl monomer having the functional group exceeds the above range, an increase in a charge amount of a toner at a low temperature and a low humidity becomes large so that printing soiling may be generated.

As the charge control resin having a positively charging ability, a charge control resin having a positively charging ability having a weight average molecular weight of 2,000 to 30,000 may be preferable, more preferably from 4,000 to 25,000, and most preferably from 6,000 to 20,000.

A glass transition temperature of the charge control resin having a positively charging ability is preferably from 40 to 100° C., more preferably from 45 to 80° C., and most preferably from 45 to 70° C. If the glass transition temperature is less than the above range, shelf stability of the toner may decrease. If the glass transition temperature exceeds the above range, fixing ability may lower.

A compounding amount of the charge control agent is preferably from 0.1 to 10 parts by weight with respect to the polymerizable monomer used to obtain the binder resin of 100 parts.

A colored particle may preferably contain the release agent. As the release agent, for example, there may be a polyolefin wax such as low-molecular-weight polyethylene, low-molecular-weight polypropylene, low-molecular-weight polybutylene or the like; a natural wax such as candelilla, a carnauba wax, a rice wax, a haze wax, jojoba or the like; a petroleum wax such as paraffin, microcrystalline, petrolactam or the like, and a modified wax thereof; a synthesized wax such as a Fischer-Tropsch wax or the like; a multifunctional esterified compound such as pentaerythritol tetramyristate, pentaerythritol tetrastearate, pentaerythritol tetrapalmitate, dipentaerythritol hexamyristate, dipentaerythritol hexastearate or the like; and so on.

The release agent may be used alone or in combination with two or more kinds.

A compounding amount of the release agent is generally from 0.5 to 50 parts by weight, preferably from 1 to 20 parts by weight, with respect to the binder resin of 100 parts by weight.

It is preferable that the colored particle is a so-called core-shell type particle, which can be obtained by using two different polymers, one for the inside of the particle (a core layer) and another for the outside of the particle (a shell layer), in combination since the core-shell type particle can balance lowering a minimum fixing temperature and shelf stability of the toner by covering a substance having a low softening point inside (a core layer) with a substance having a higher softening point.

A method of producing the core-shell type particle may be preferably a method of forming a shell layer by an in situ method on a particle to be a core layer produced by a polymerization method.

The colored particle can be produced by conventionally known methods such as the pulverizing method; the polymerization method such as the emulsion polymerization method, the suspension polymerization method or the like; the phase inversion emulsion method; the solution suspension method and so on. Among the production methods, producing the colored particle by the solution suspension method or the polymerization method is preferable since a colored particle having a sharp particle size distribution can be obtained. Among the polymerization methods, the suspension polymerization method is most preferable.

In the suspension polymerization method, a colorant and, if necessary, other components such as a charge control agent, a release agent or the like are dissolved or dispersed in a polymerizable monomer which is a material of a binder resin so as to prepare a polymerizable monomer composition. After the polymerizable monomer composition is added in an aqueous dispersion medium containing a dispersion stabilizer, a droplet of the polymerizable monomer composition is formed so as to obtain a dispersion liquid. A polymerization initiator is added to the dispersion liquid containing the droplet to perform polymerization, and particles are associated with each other, if required. Then, filtering, washing, dewatering and drying are performed to produce a colored particle.

In the present invention, it is preferable that the obtained colored particle is subject to washing by a water-soluble organic solvent such as methanol or the like after the above-mentioned washing. By washing the colored particle with the water-soluble organic solvent, the dispersion stabilizer, the polymerizable monomer and so on remained on the surface of the colored particle can be removed, thereby, the uniaxial collapsing stress and the internal frictional angle can be adjusted within the specified ranges.

Particularly, in the case of producing the core-shell type colored particle, a core layer, which is a colored particle obtained by one of the above-mentioned methods, is covered with a shell layer by a conventionally known method such as a spray dry method, an interface reaction method, an in situ polymerization method, a phase separation method or the like. It is preferable that a colored particle produced by the polymerization method is covered with a shell layer by the in situ polymerization method.

As the monovinyl monomer, for example, there may be an aromatic vinyl monomer such as styrene, vinyl toluene, α-methyl styrene or the like; a (meth)acrylic acid based monomer such as (meth)acrylic acid, methyl (meth)acrylate, ethyl (meth)acrylate, propyl (meth)acrylate, butyl (meth) acrylate, 2-ethylhexyl (meth)acrylate, cyclohexyl (meth) acrylate, isobornyl (meth)acrylate, dimethyl aminoethyl (meth)acrylate, (meth)acrylamide or the like; a monoolefin monomer such as ethylene, propylene, butylene or the like; and so on. In the present invention, "(meth)acrylic acid" refers to "methacrylic acid and acrylic acid".

The above monovinyl monomer may be used alone or in combination of two or more kinds. Among the monovinyl monomers, the aromatic vinyl monomer alone or a combination of the aromatic vinyl monomer and the (meth)acrylic acid based monomer may be preferably used.

In order to prevent hot offset, any crosslinkable monomer maybe preferably used together with the monovinyl monomer. The crosslinkable monomer means a monomer having two or more polymerizable functional groups. As the crosslinkable monomer, for example, there may be an aromatic divinyl compound such as divinyl benzene, divinyl naphthalene, a derivative thereof or the like. The crosslinkable monomer may be used alone or in combination of two or more kinds.

Further, it is preferable to use a macromonomer as a part of the polymerizable monomer so that shelf stability and fixing ability at a low temperature are well-balanced. The macromonomer is a reactive oligomer or polymer which has a polymerizable carbon-carbon unsaturated double bond at the end of a polymer chain and a number average molecular weight of 1,000 to 30,000 generally.

A macromonomer which provides a polymer having higher Tg than that of a polymer obtained by polymerization of the monovinyl monomer is preferable. An amount of the macromonomer is generally from 0.01 to 10 parts by weight, preferably from 0.03 to 5 parts by weight, more preferably from 0.05 to 1 part by weight, with respect to the monovinyl monomer of 100 parts by weight.

As the dispersion stabilizer, there may be an inorganic compound which is soluble in acid or alkali such as a metallic compound or the like including sulfate such as barium sulfate, calcium sulfate or the like; carbonate such as barium carbonate, calcium carbonate, magnesium carbonate or the like; phosphate such as calcium phosphate or the like; metal oxide such as aluminum oxide, titanium oxide or the like; metal hydroxide such as aluminum hydroxide, magnesium hydroxide, ferric hydroxide or the like.

Among the above dispersion stabilizers, a dispersion stabilizer containing a colloid of the metallic compound, particularly a hardly water-soluble metal hydroxide, is preferable since a particle size distribution of the colored particle can be narrowed, and a residual amount of the dispersion stabilizer after washing is small so that a toner to be obtained can sharply reproduce an image and environmental stability of the toner may not be decreased.

An amount of the dispersion stabilizer may be from 0.1 to 20 parts by weight, preferably from 0.2 to 10 parts by weight, with respect to the aqueous medium of 100 parts by weight.

In the present invention, as a polymerization initiator used for polymerization of the polymerizable monomer composition, for example, there may be a persulfate including potassium persulfate, ammonium persulfate or the like; an azo compound such as 4,4'-azobis(4-cyanovaleric acid), 2,2'-azobis(2-methyl-N-(2-hydroxyethyl)propionamide), 2,2'-azobis (2-amidinopropane) dihydrochloride, 2,2'-azobis(2,4-dimethylvaleronitrile), 2,2'-azobisisobutyronitrile or the like; organic peroxide such as di-t-butyl peroxide, benzoyl peroxide, t-butylperoxy-2-ethylhexanoate, t-hexylperoxy-2-ethylhexanoate, t-butylperoxy pivalate, diisopropyl peroxydicarbonate, di-t-butylperoxy isophthalate, t-butylperoxy isobutylate or the like. Also, a redox initiator, which is a combination of the polymerization initiator and a reducing agent, may be used. Among them, organic peroxide may be preferably used since a residual amount of the polymerizable monomer can be reduced, and printing durability is good.

After the polymerizable monomer composition is dispersed in the aqueous medium and before forming droplets, the polymerization initiator may be added as mentioned above, but also the polymerization initiator may be added to the polymerizable monomer composition before forming droplets.

An added amount of the polymerization initiator used for polymerization of the polymerizable monomer composition may be preferably from 0.1 to 20 parts by weight, more preferably from 0.3 to 15 parts by weight, most preferably from 1.0 to 10 parts by weight, with respect to the monovinyl monomer of 100 parts by weight.

Further, upon polymerization, the molecular weight modifier may be preferably used. As the molecular weight modifier, there may be mercaptans such as t-dodecyl mercaptan, n-dodecyl mercaptan, n-octyl mercaptan, 2,2,4,6,6-pentamethylheptane-4-thiol or the like. The molecular weight modifier can be added before or during polymerization. An amount of the molecular weight modifier is preferably from 0.01 to 10 parts by weight, more preferably from 0.1 to 5 parts by weight, with respect to the monovinyl monomer of 100 parts by weight.

As a polymerizable monomer for shell, the above-mentioned polymerizable monomer or the like can be similarly used. Among them, a monomer which provides a polymer having Tg of more than 80° C. such as styrene, acrylonitrile, methyl methacrylate or the like may be preferably used alone or in combination with two or more kinds.

As a polymerization initiator used for polymerization of the polymerizable monomer for shell, there may be water-soluble polymerization initiators such as a metal persulfate including potassium persulfate, ammonium persulfate or the like; an azo initiator such as 2,2'-azobis(2-methyl-N-(2-hydroxyethyl) propionamide), 2,2'-azobis-(2-methyl-N-(1,1-bis (hydroxymethyl)2-hydroxyethyl)propionamide) or the like, and so on. An amount of the polymerization initiator, with respect to the polymerizable monomer for shell of 100 parts by weight, is preferably from 0.1 to 30 parts by weight, more preferably from 1 to 20 parts by weight.

In the present invention, the colored particle obtained by the above-mentioned method, preferably the core-shell type colored particle, to which the external additive is attached, can be used as a one-component toner. Further, the colored particle mixed with a carrier or other microparticles by means of a mixer such as a v-type mixer or the like can be used as a two-component toner.

The toner for developing electrostatic image of the present invention may preferably contain the external additive so that the uniaxial collapsing stress and the internal frictional angle can be easily controlled within the above-mentioned ranges. Also, by attaching the external additive to or burying in the surface of the colored particle, charge property, shelf stability or the like of the toner can be controlled.

An added amount of the external additive is preferably from 0.01 to 3 parts by weight, more preferably from 0.5 to 2.5 parts by weight, most preferably from 0.7 to 2 parts by weight with respect to the colored particle of 100 parts by weight from the viewpoint of colorability and fixing ability of the toner.

The toner for developing electrostatic image of the present invention may preferably contain an inorganic microparticle (A) having a small particle diameter, a number average primary particle diameter of which is from 5 to 14 nm, as the external additive. If the toner for developing electrostatic image of the present invention contains the inorganic microparticle (A) having a small particle diameter, flowability of the toner is improved so that the internal frictional angle becomes more controllable within the above-specified range.

As the inorganic microparticle (A) having a small particle diameter, inorganic particles which are conventionally used as external additives of a toner can be used without limit. There may be a particle of silica, aluminum oxide, titanium oxide, zinc oxide, tin oxide or the like. Among the above, the particle of silica, aluminum oxide or titanium oxide may be preferable, and the particle of silica may be more preferable.

A ratio of the inorganic microparticle (A) having a small particle diameter may be preferable from 30 to 80 wt % of the amount of the external additive.

The toner for developing electrostatic image of the present invention may preferably contain an inorganic microparticle (B) having a medium particle diameter, a number average primary particle diameter of which is from 15 to 90 nm, as the external additive. The toner containing the inorganic microparticle (B) as the external additive can improve cleaning performance of the toner to be obtained and adjust the uniaxial collapsing stress and the internal frictional angle within the preferable ranges.

As the inorganic microparticle (B) having a medium particle diameter, inorganic particles which are conventionally used as external additives of the toner can be used without limit. As the inorganic particle, there may be a particle of silica, aluminum oxide, titanium oxide, zinc oxide, tin oxide or the like. Among them, the particle of silica and the particle of titanium oxide may be suitable, and titanium oxide may be more preferable.

A ratio of the inorganic microparticle (B) having a medium particle diameter may be preferable from 5 to 50 wt % of the amount of the external additive.

In the present invention, a hydrophobicity measured by a methanol method of the inorganic microparticle (A) having a small particle diameter and/or the inorganic microparticle (B) having a medium particle diameter contained as the external additive is preferably from 50 to 100%, more preferably from 55 to 90%.

If the hydrophobicity is less than the above range, decrease in the charge amount under an environment of a high-temperature and a high-humidity may easily occur due to moisture adsorption.

Measurement of the hydrophobicity by the methanol method can be performed, for example, as follows.

A certain weight of a sample of the inorganic microparticle is weighed and added with a given volume of pure water. Next, methanol is added under a liquid surface. When no sample is visually observed on the liquid surface is referred to as an end point, the hydrophobicity is calculated by the following formula:

$$\text{hydrophobicity } (\%)=(X/(Y+X))\times 100$$

wherein, X: amount (ml) of methanol used; and Y: amount (ml) of pure water used.

The hydrophobicity can be adjusted by performing a hydrophobicity-imparting treatment on the surface of the inorganic microparticle (A) having a small particle diameter and/or the inorganic microparticle (B) having a medium particle diameter. Conventionally and commonly known methods can be employed as the hydrophobicity-imparting treatment. For example, there may be treating methods such as a wet treating method or a dry treating method using a surface modifying agent including a silane coupling agent, a titanate coupling agent, an Al coupling agent, a silicone oil or the like can be applied to the inorganic microparticle (A) having a small particle diameter and the inorganic microparticle (B) having a medium particle diameter.

Furthermore, in the present invention, the toner for developing electrostatic image of the present invention may preferably contain a particle (C) having a large particle diameter, a number average primary particle diameter of which is from 100 to 500 nm, as the external additive to diminish cohesion of the toner and to improve cleaning performance.

As the particle (C) having a large particle diameter, external additives which are conventionally used for a toner such as, for example, an inorganic particle or an organic resin particle can be used without limit. As the inorganic particle, there may be a particle of silica, aluminum oxide, titanium oxide, zinc oxide, tin oxide or the like. As the organic resin particle, there may be a (meth)acrylate ester polymer particle, a styrene-(meth)acrylate ester copolymer particle or the like, and the organic resin particle is preferable.

A ratio of the particle (C) having a large particle diameter may be preferable from 1 to 20 wt % of the amount of the external additive.

To use the toner of the present invention as a two-component toner, a carrier is attached to the colored particle. As the carrier, carriers which are conventionally used for the toner can be used without limit. For example, there may be magnetic powder such as iron powder, ferrite or nickel powder, glass beads or the like, or those of surface-treated with a fluorine resin, a styrene/acrylic resin, a silicone resin or the like, and so on.

In the case of the two-component toner, a concentration of the colored particle in the toner is generally from 0.1 to 50 wt %, preferably from 0.5 to 15 wt %, more preferably from 3 to 10 wt %.

In the present invention, from the viewpoint of improving an image quality such as image reproducibility, fineness or the like, a toner having a small particle diameter and a sharp particle size distribution may be preferably used.

A volume average particle diameter (Dv) of the toner in the present invention is controlled in the range of 4.0 to 8.0 μm, more preferably in the range of 4.0 to 7.0 μm. If Dv is less than the above range, a toner may leak from a sealing portion and soil inside of an image forming device and flowability of the toner may decrease. Thereby, generation of a fog, generation of a remaining toner or decrease in cleaning property may occur. On the other hand, if Dv exceeds the above range, reproductivity of thin lines may decline so that high-quality images cannot be obtained or fixing ability may lower.

An average circularity (Ca) of the toner is preferably from 0.940 to 0.980, more preferably from 0.940 to 0.970.

If the average circularity is less than the above range, shape uniformity of the toner decreases so that reproductivity of thin lines may decline.

On the other hand, if the average circularity exceeds the above range, the toner becomes more spherical. Hence, the toner can pass between a photosensitive member and a cleaning blade, and cleaning performance may decrease. It is possible to adjust the shape of the toner to be close to an absolute sphere, an average circularity of which is more than 0.980 by employing the above-mentioned polymerization method. However, the average circularity of the toner in the present invention is specified as 0.980 or less particularly from the viewpoint of improving cleaning performance.

The shape of the toner of the present invention is preferably a spindle (or an ellipse) as far as the average circularity satisfies the above range from the viewpoint of improving cleaning ability of the toner. A method of obtaining the toner in a shape of a spindle (spindle shaping treatment), for example, is that a polymerizable monomer composition preliminarily polymerized is cooled down upon the polymerization conversion rate is from 25 to 95%, preferably from 30 to 90%, more preferably from 40 to 80%, and then the obtained droplet of the polymerizable monomer composition is subjected to a high shear stirring so as to prepare the toner in a shape of a spindle. A peripheral speed upon the high shear stirring is from 5,000 to 25,000 rpm, more preferably from 10,000 to 20,000 rpm.

In the present invention, the circularity is a value obtained by dividing a perimeter of a circle having the same area as a projected image of a particle by a perimeter of the projected image of the particle. Also, the circularity is used as a simple method of presenting a shape of a particle quantitatively and is an indicator showing the level of convexo-concave shapes of the toner. The average circularity is "1" when the toner is an absolute sphere, and becomes smaller as the shape of the surface of the toner becomes more complex. In order to obtain the average circularity (Ca), firstly, a circularity (Ci) of each of measured "n" particles of 0.4 μm or more by a diameter of the equivalent circle is calculated by the following formula:

circularity (Ci)=a perimeter of a circle having the same area as a projected area of a particle/a perimeter of the projected image of the particle Next, the average circularity (Ca) is obtained by the following formula:

$$\text{average circularity} = \left(\sum_{i=1}^{n}(Ci \times fi)\right) \Big/ \sum_{i=1}^{n}(fi)$$

wherein, "fi" is a frequency of a particle of the circularity (Ci).

The above average circularity can be measured by means of a flow particle image analyzer (product name: FPIA-2100 or FPIA-3000; manufactured by Sysmex Co.).

In the present invention, shape factors SF 1 and SF 2 can be used to define a shape of the toner.

The shape factor SF 1 represents a level of distortion of a toner and can be defined by the following formula:

definitional formula of SF 1:

$$\text{shape factor } (SF\ 1) = \frac{(MXLNG)^2}{\text{AREA}} \times \frac{\pi}{4} \times 100$$

wherein, MXLNG is an absolute maximum length of a toner; and AREA is a projected area of the toner.

When the shape of the toner is absolute spherical, the shape factor SF 1 indicates 100. The shape of the toner is close to an absolute sphere when the shape factor SF 1 is less than 120. When the shape factor SF 1 is 120 or more, the shape of the toner is distorted to be a spindle (or an ellipse) rather than a sphere. In the present invention, the shape factor SF 1 is preferably from 130 to 150, more preferably from 130 to 140, since cleaning performance of the toner improves.

The shape factor SF 2 indicates a degree of fine convexo-concave shapes on the surface of a toner and defined by the following formula:

definitional formula of SF 2:

$$\text{shape factor } (SF\ 2) = \frac{(PELI)^2}{\text{AREA}} \times \frac{1}{4\pi} \times 100$$

wherein, PELI means a perimeter of a projected image of a toner; and AREA means a projected area of the toner.

In the present invention, the shape factor SF 2 is preferably from 100 to 120, more preferably from 100 to 110. If the shape factor SF 2 exceeds the above range, the toner may lose its smooth surface nature and may not obtain sharp charge property. Hence, problems such as toner scattering and so on may easily occur. Furthermore, the released external additive can easily adhere to a developing roller at a low temperature and a low humidity so that unevenness of an image may be easily caused.

The shape factor of the toner can be obtained, for example, as follows. Toners are photographed by means of a field emission scanning electron microscope or the like. After sampling 100 images of the toners from thus obtained picture, the particle images are subject to image analysis and the shape factors can be obtained by the above-mentioned formulae.

The toner of the present invention is excellent in reproductivity of thin lines and cleaning performance. Therefore, high quality images with high printing density can be formed by the toner for developing electrostatic image of the present invention.

Figure 3:
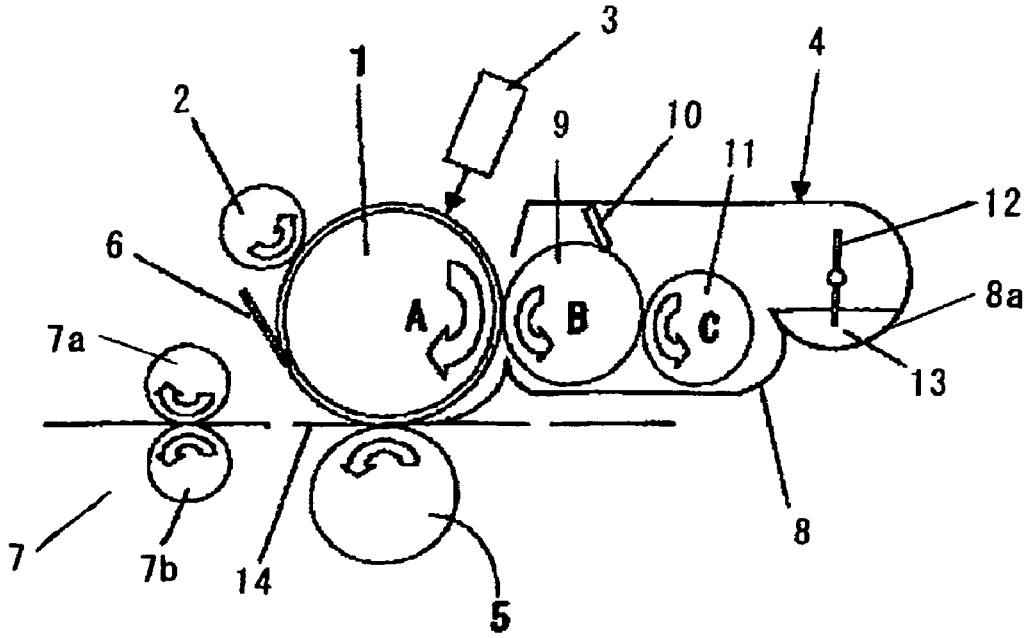
FIG. 3 is a view showing a constitutional example of an electrophotography device to perform an image forming method, to which a toner of the present invention is applied.

FIG. 3 shows an example of a constitution of an image forming device to which the toner provided by the present invention is applied. In FIG. 3, an electrophotographic apparatus shown in FIG. 3 has a photosensitive dram 1 as a photosensitive member, and the photosensitive dram 1 is mounted so as to be able to rotate freely in the direction of an arrow "A". The photosensitive dram 1 comprises a conductive support dram member and a photoconductive layer provided on the conductive support dram. The photoconductive layer is formed of, for example, an organic photoconductor, a selenium photoconductor, a zinc oxide photoconductor, an amorphous silicon photoconductor or the like. Among them, the organic photoconductor is preferable. The photoconductive layer is bound to the conductive support dram. As a resin used to bind the photoconductive layer to the conductive support dram, for example, there may be a polyester resin, an acrylic resin, a polycarbonate resin, a phenolic resin, an epoxy resin or the like. Among them, the polycarbonate resin is preferable.

Around the photosensitive dram 1 along the circumferential direction thereof, a charging roller 2 as a charging member, a light radiation device 3 as exposure equipment, a development device 4, a transfer roller 5 and a cleaning blade 6 are arranged.

Also, on the downstream side of the conveying direction of the photosensitive dram 1 and the transfer roller 5, a fixing device 7 is provided. The fixing device 7 comprises a heating roller 7*a* and a support roller 7*b*.

The conveying route of a recording material 14 is provided so that the recording material is conveyed between the photosensitive dram 1 and the transfer roller 5, and between the heating roller 7*a* and the support roller 7*b*.

A development device 4 is a development device used for a one-component contact developing method, comprising a developing roller 9, a blade 10 for the developing roller which is to scrape off an excess toner on the developing roller, a supply roller 11 and a stirring vane 12 to stir the toner in a casing 8 in which a toner 13 is stored.

A method of forming an image with the use of the image forming device as shown in FIG. 3 comprises processes of a charging process, an exposure process, a developing process, a transferring process, a cleaning process and a fixing process as follows.

The charging process is a process to charge positively or negatively the surface of the photosensitive dram 1 uniformly.

The exposure process is a process to radiate lights corresponding to image signals on the surface of the photosensitive dram 1 by means of the light radiation device 3 as an exposure device as shown in FIG. 3, and to form a latent image of electrostatics on the surface of the photosensitive dram 1 charged uniformly.

The developing process is a process to attach the toner to the latent image of electrostatics formed on the surface of the photosensitive dram 1 in the exposure process by means the development device 4 so as to form a visible image. The toner is attached only to a light radiated part in the case of reversal, and the toner is attached only to a light non-radiated part in the case of normal development.

The transferring process is a process to transfer the visible image formed on the surface of the photosensitive dram 1 by means of the development device 4 to the transferring material 14 such as paper or the like.

The cleaning process is a process of cleaning the toner remained on the surface of the photosensitive dram 1 after the transferring process. In the present invention, the cleaning blade 6 is arranged to closely contact the surface of the photosensitive dram 1 so as to scrape off the toner remained on the surface of the photosensitive dram 1. The scraped toner is recovered by a recovery device (not shown).

In the image forming device as shown in FIG. 3, after the whole surface of the photosensitive dram 1 is uniformly charged negatively by the charging roller 2, a latent image of electrostatics is formed by means of the light radiation device 3. Further, a visible image is developed by means of the development device 4. Next, the visible image on the photosensitive dram 1 is transferred to the transferring material 14 such as paper or the like by means of the transfer roller 5. The toner remained on the surface of the photosensitive dram 1 is cleaned by means of the cleaning blade 6. After that, a new image forming cycle begins.

The fixing process is a process to fix the visible image transferred to the transferring material 14. In the image forming device as shown in FIG. 3, at least one of the heating roller 7*a* heated by a heating means (not shown) and the support roller 7*b* is rotated, and the transferring material 14 passes therethrough so as to be heated and pressed.

The image forming device shown in FIG. 3 is an image forming device for monochrome, however, the image forming method of the present invention can be applied to a color image forming device such as a copying machine, a printer or the like.

The above-mentioned toner of the present invention is widely used for a developing system of a latent image of electrostatics, a developing method, an image forming device to develop a latent image of electrostatics so as to form an image such as a picture, a drawing, a character, a symbol or the like in an electrophotography, an electrostatic recording method, an electrostatic printing process or the like.

EXAMPLES

Hereinafter, the present invention will be explained further in detail with reference to examples. However, the scope of the present invention may not be limited to the following examples.

Herein, "part(s)" and "%" are based on part(s) by weight or % by weight if not particularly mentioned.

Example 1

Wet pulverization is performed on 80.5 parts of styrene, 19.5 parts of n-butyl acrylate, 0.4 parts of divinyl benzene, 0.8 parts of t-dodecyl mercaptan and 7 parts of carbon black (product name: #25B; manufactured by Mitsubishi Chemical Corporation) by means of a media type wet pulverizer (product name: Dynomil KDL-P; manufactured by Sinmaru Enterprises), and added 5 parts of a negatively charge control resin (product name: FCA-626-NS; manufactured by Fujikura Kasei Co., Ltd.) and 10 parts of dipentaerythritol hexamyristate (manufactured by NOF Corporation) followed by mixing and dissolving so as to obtain a polymerizable monomer composition.

On the one hand, an aqueous solution of 6.6 parts of sodium hydroxide dissolved in 50 parts of ion-exchanged water was gradually added into an aqueous solution of 11.8 parts of magnesium chloride dissolved in 250 parts of ion-exchanged water while stirring so as to prepare an aqueous medium containing magnesium hydroxide colloid (magnesium hydroxide colloid dispersion liquid).

Separately, 1 part of methyl methacrylate and 65 parts of ion-exchanged water were mixed to prepare an aqueous dispersion of a polymerizable monomer for shell.

The polymerizable monomer composition was added into the magnesium hydroxide colloid dispersion liquid and agitated.

As a polymerization initiator, 6 parts of t-butyl peroxyisobutylate (product name: PERBUTYL IB; manufactured by NOF Corporation) was added. A high shear stirring was performed at 15,000 rpm for 30 minutes by means of an in-line type emulsifying and dispersing machine (product name: MILDER; manufactured by Ebara Corporation) to form droplets of the polymerizable monomer composition.

The aqueous medium containing the magnesium hydroxide colloid having the droplets of the polymerizable monomer composition dispersed was charged into a reactor furnished with a stirring vane, and the temperature of the reactor was raised to 95° C. After about 40 minutes (a polymerization conversion rate of the polymerizable monomer was about 55%.), the temperature of the aqueous medium was lowered to 40° C. A high shear stirring was performed again at 18,000 rpm for 5 minutes by means of the in-line type emulsifying and dispersing machine so that the droplets have an ellipse shape. Furthermore, the temperature of the reactor was raised to 95° C. When the polymerization conversion rate reached almost 100%, 0.1 parts of 2,2'-azobis[2-methyl-N-(2-hydroxyethyl)propionamide] (product name: VA086; manufactured by Wako Pure Chemical Industries, Ltd.) as a polymerization initiator for the polymerizable monomer for shell was dissolved into the aqueous dispersion of the polymerizable monomer for shell and charged into the reactor. Polymerization was continued for 4 hours and then stopped so as to obtain an aqueous dispersion of a core-shell type colored particle.

10% sulfuric acid was added into the obtained aqueous dispersion of the colored particle to be pH 4.5 while agitating at room temperature, and thus dissolved the magnesium hydroxide. The aqueous dispersion was filtrated and dewatered. Then, ion-exchanged water was added by 250 parts, and thus obtained aqueous dispersion was subject to filtering and dewatering again. After adding 250 parts of methanol and agitating for 1 hour, filtering and dewatering were performed followed by drying, thus obtained a colored particle.

While cooling a jacket of a Henschel mixer with water, as external additives, 0.7 parts of a silica microparticle having a number average primary particle diameter of 12 nm (product name: H2000; hydrophobicity=80%; manufactured by Clariant Corp.), 0.3 parts of a titanium oxide microparticle having a number average primary particle diameter of 15 nm (product name: JMT150-AO; hydrophobicity=70%; manufactured by Tayca Corporation) and 0.1 parts of a silica particle having a number average primary particle diameter of 150 nm were added to 100 parts of the obtained colored particle and agitated at 1,400 rpm for 10 minutes, thus obtained a toner of Example 1. A volume average particle diameter of the toner was 6.7 μm, and an average circularity was 0.962.

Comparative Example 1

A polymerizable monomer comprising 80.5 parts of styrene, 19.5 parts of n-butyl acrylate, 0.4 parts of divinyl benzene and 0.25 parts of methacrylic acid ester macromonomer (product name: AA-6; manufactured by Toagosei Co., Ltd.), 7 parts of carbon black (product name: #25B; manufactured by Mitsubishi Chemical Corporation), 2 parts of a charge control resin (product name: FCA-626-NS; manufactured by Fujikura Kasei Co., Ltd.), 1 part of t-dodecyl mercaptan and 10 parts of dipentaerythritol hexamyristate (manufactured by NOF Corporation) were dispersed by means of a beads mill at room temperature, and thus obtained a polymerizable monomer composition.

An aqueous solution of 6.0 parts of sodium hydroxide dissolved in 50 parts of ion-exchanged water was gradually added into an aqueous solution of 9.9 parts of magnesium chloride dissolved in 250 parts of ion-exchanged water while stirring so as to prepare an aqueous medium containing magnesium hydroxide colloid (magnesium hydroxide colloid dispersion liquid).

Separately, 1 part of methyl methacrylate and 65 parts of ion-exchanged water were mixed to prepare an aqueous dispersion of a polymerizable monomer for shell.

The polymerizable monomer composition was added to the magnesium hydroxide colloid dispersion liquid and agitated until droplets of the polymerizable monomer composition were stable. As a polymerization initiator, 5 parts of t-butylperoxy-2-ethylhexanoate (product name: PERBUTYL O; manufactured by NOF Corporation) was added. Then, droplets of the polymerizable monomer composition was formed by means of an in-line type emulsifying and dispersing machine (product name: MILDER; manufactured by Ebara Corporation) which is able to revolve at 15,000 rpm.

1 part of sodium tetraborate decahydrate was added into the magnesium hydroxide colloid dispersion liquid in which the polymerizable monomer composition was dispersed to form the droplets and was charged into a reactor furnished with a stirring vane followed by polymerization at 85° C. When a polymerization conversion rate reached almost 100%, 0.1 parts of 2,2'-azobis[2-methyl-N-(2-hydroxyethyl)propionamide] (product name: VA086; manufactured by Wako Pure Chemical Industries, Ltd.) as a water-soluble polymerization initiator was dissolved into the aqueous dispersion of the polymerizable monomer for shell and charged into the reactor. Polymerization was continued for 4 hours and then stopped so as to obtain an aqueous dispersion of a core-shell type colored particle.

Sulfuric acid was added in thus obtained aqueous dispersion of the colored particle to be pH 4 or less while agitating so as to perform acid washing. After water was separated by filtering, ion-exchanged water was newly added by 500 parts to make slurry so as to perform washing with water. Thereafter, dewatering and washing with water was repeated for several times. After separating solid content by filtrating, drying at 45° C. by a dryer two days and nights (48 hours) was performed, thus obtained a dried colored particle.

As external additives, 0.7 parts of a silica microparticle having a number average primary particle diameter of 12 nm (product name: R104; hydrophobicity=65%; manufactured by Nippon Aerosil Co., Ltd.) and 0.3 parts of a styrene-methyl methacrylate copolymer particle having a number average primary particle diameter of 400 nm were added to 100 parts of thus obtained colored particle and mixed by means of a Henschel mixer for 10 minutes at 1,400 rpm. Thus, a toner of Comparative example 1 was obtained. The toner has a volume average particle diameter of 9.5 μm and an average circularity of 0.982.

Comparative Example 2

In the same manner as Comparative example 1 except that only 0.5 parts of the silica microparticle having a number average primary particle diameter of 12 nm (product name: R104; hydrophobicity=65%; manufactured by Nippon Aerosil Co., Ltd.) was added as the external additive, a toner of Comparative example 2 was obtained. The toner of Comparative example 2 has a volume average particle diameter of 9.8 μm and an average circularity of 0.986 after drying.

Comparative Example 3

24 parts of methyl ethyl ketone and 6 parts of methanol were dispersed in 100 parts of a charge control resin (monomer unit having a sulfonic acid group: 7 wt %, product name: FCA-626-N; manufactured by Fujikura Kasei Co., Ltd.), and then mixed with a roll while cooling. After the charge control resin was wrapped around the roll, 100 parts of carbon black (product name: #25B; manufactured by Mitsubishi Chemical Corporation) was gradually added and mixed for 1 hour so as to obtain a charge control resin composition.

A polymerizable monomer comprising 80.5 parts of styrene, 19.5 parts of n-butyl acrylate, 0.4 parts of divinyl benzene and 0.25 parts of polymethacrylic acid ester macromonomer (product name: AA-6; manufactured by Toagosei Co., Ltd.), 12 parts of the charge control resin composition and 10 parts of dipentaerythritol hexamyristate were agitated and mixed to be dispersed uniformly, and thus obtained a polymerizable monomer composition.

On the other hand, an aqueous solution of 6.6 parts of sodium hydroxide dissolved in ion-exchanged water was gradually added into an aqueous solution of 10.8 parts of magnesium chloride dissolved in 250 parts of ion-exchanged water while stirring so as to prepare an aqueous medium containing magnesium hydroxide colloid (magnesium hydroxide colloid dispersion).

Separately, 2 parts of methyl methacrylate and 65 parts of water were subject to finely-dispersing treatment by means of an ultrasonic emulsifying machine to prepare an aqueous dispersion of a polymerizable monomer for shell.

The polymerizable monomer composition was charged into the magnesium hydroxide colloid dispersion (amount of colloid: 4.8 parts) and agitated so that droplets become stable. Then, 5 parts of t-butylperoxy-2-ethylhexanoate (product name: PERBUTYL O; manufactured by NOF Corporation) as a polymerization initiator and 1 part of triisobutyl mercaptan (manufactured by Bayer Ltd.) and 1 part of tetraethylthiuram disulfide (manufactured by OUCHI SHINKO CHEMICAL INDUSTRIAL CO., LTD.) as chain transfer agents were added. Next, a high shear stirring was performed at 15,000 rpm for 30 minutes by means of an in-line type emulsifying and dispersing machine (product name: MILDER; manufactured by Ebara Corporation) to form droplets of a polymerizable monomer composition for core. The aqueous dispersion of the polymerizable monomer for core was charged into a reactor furnished with a stirring vane and subject to polymerization reaction at a temperature of 90° C. When the polymerization conversion rate reached almost 100%, the aqueous dispersion of a polymerizable monomer for shell and 0.2 parts of 2,2'-azobis[2-methyl-N-(2-hydroxyethyl)propionamide] (product name: VA086; manufactured by Wako Pure Chemical Industries, Ltd.) as a polymerization initiator dissolved in 65 parts of distilled water were charged into the reactor. Polymerization was continued for 4 hours and then stopped so as to obtain an aqueous dispersion of a colored particle.

Sulfuric acid was added in thus obtained aqueous dispersion of the colored particle to be pH 5 or less while agitating so as to perform acid washing at 25° C. for 10 minutes. After water was separated by filtering, ion-exchanged water was newly added by 500 parts to make slurry so as to perform washing with water. Thereafter, dewatering and washing with water was repeated for several times. After separating solid content by filtrating, drying at 45° C. by a dryer was performed for two days and nights (48 hours), thus obtained a dried colored particle.

As external additives, 0.5 parts of a metal oxide particle with a layer of silica (product name: $Al_2O_3$-SDS; manufactured by Fuji Pigment Co., Ltd.) having a number average primary particle diameter of 90 nm, wherein a core layer is alumina and a shell layer is silica, 0.5 parts of a silica microparticle having a number average primary particle diameter of 12 nm (hydrophobicity=65%, product name: R104; manufactured by Nippon Aerosil Co., Ltd.) and 2.0 parts of a silica microparticle having a number average primary particle diameter of 40 nm (hydrophobicity=64%, product name: NAX-50; manufactured by Nippon Aerosil Co., Ltd.) were added to 100 parts of thus obtained colored particle and mixed by means of a Henschel mixer for 10 minutes at 1,400 rpm, thereby, a toner of Comparative example 3 was obtained. The toner has a volume average particle diameter of 6.4 μm and an average circularity of 0.985.

Comparative Example 4

100 parts of a styrene-butyl acrylate copolymer as a binder resin, which was passed through a screen of 2 mm (Mw≈10,000), 5 parts of carbon black (product name: #25B; manufactured by Mitsubishi Chemical Corporation), and 2 parts of aluminum salicylate as a charge control agent having a negatively charging ability were charged into a mixing and kneading machine and mixed for 2 hours. Next, dry dispersion was performed by scraping and pulverizing by means of a mix muller (manufactured by Sintokogio, Ltd.) followed by mixing and kneading by means of an extruder (product name: PCM-30; manufactured by Ikegai Corporation) at a barrel temperature of 120° C. and 250 rpm. Thus kneaded and mixed product was cooled down, and then roughly pulverized by means of a speed mill having a screen of 2 mmϕ.

Next, thus obtained roughly pulverized product was subject to pulverization by means of an I type jet mill followed by removing fine powders and rough powders by means of an elbojet classifier, thus obtained a colored particle.

As an external additive, 0.7 parts of a hydrophobic silica microparticle having a number average primary particle diameter of 12 nm (treated with a silane coupling agent, hydrophobicity=65%, product name: R104; manufactured by Nippon Aerosil Co., Ltd.) was added to 100 parts of thus obtained colored particle and mixed so as to obtain a toner of Comparative example 4. The toner has a volume average particle diameter of 8.3 μm and an average circularity of 0.938 after drying.

Comparative Example 5

In the same manner as Example 1 except that 1.0 part of a silica microparticle having a number average primary particle diameter of 12 nm (hydrophobicity=80%, product name: H2000; manufactured by Clariant Corp.) and 5.5 parts of a silica particle having a number average primary particle diameter of 350 nm were added as the external additives, a toner of Comparative example 5 was obtained. The toner has a volume average particle diameter of 6.7 μm and an average circularity of 0.963 after drying.

Comparative Example 6

In the same manner as Example 1 except that 0.7 parts of a silica microparticle having a number average primary particle diameter of 12 nm (hydrophobicity=35%, product name: R974; manufactured by Nippon Aerosil Co., Ltd.), 0.3 parts of a titanium oxide microparticle having a number average primary particle diameter of 20 nm (hydrophobicity=30%, product name: JMT150-FI; manufactured by Tayca Corporation) and 0.1 parts of a silica particle having a number average primary particle diameter of 150 nm were added as the external additives, a toner of Comparative example 6 was obtained. The toner has a volume average particle diameter of 6.9 μm and an average circularity of 0.965 after drying.

Comparative Example 7

In the same manner as Example 1 except that 1.0 part of a silica microparticle having a number average primary particle diameter of 12 nm (hydrophobicity=80%, product name: H200; manufactured by Clariant Corp.), 0.5 parts of a titanium oxide microparticle having a number average primary particle diameter of 25 nm (hydrophobicity=70%, product name: JMT150-AO; manufactured by Tayca Corporation) and 0.25 parts of a charge control agent having a number average primary particle diameter of 4,000 nm (product name: Bontron E-84; manufactured by Orient Chemical Industries, LTD.) were added as the external additives, a toner of Comparative example 7 was obtained. The toner has a volume average particle diameter of 6.5 μm and an average circularity of 0.961 after drying.

Testing Method

As for each of the toners, an internal frictional angle, a uniaxial collapsing stress, a volume average particle diameter (μm), an average circularity and an absolute value of a charge amount |Q/M| of a toner were measured.

As for each of the external additives, a number average primary particle diameter (nm) and a hydrophobicity were measured.

As for printing performance, a printing durability test was performed on each toner to evaluate an initial printing density under N/N environment of a normal-temperature and a normal-humidity and H/H environment of a high-temperature and a high-humidity, reproductivity of thin lines under the N/N environment, an initial charge speed (plain pattern following capability) under the N/N environment and number of printed sheet which can maintain cleaning performance under L/L environment of a low-temperature and a low-humidity.

Herein, the H/H environment refers to an environment at a temperature of 30° C. and a humidity of 80%. The N/N environment refers to an environment at a temperature of 23° C. and a humidity of 50%. The L/L environment refers to an environment at a temperature of 10° C. and a humidity of 20%.

1. Internal Frictional Angle

The internal frictional angle was measured by means of a device to measure shear stress of a powder layer wherein powders are pressed and closely contacting each other (product name: ShearScan TS12; manufactured by Sci-Tec Inc.). Specifically, a measuring method of the internal frictional angle is as follows.

Figure 4:
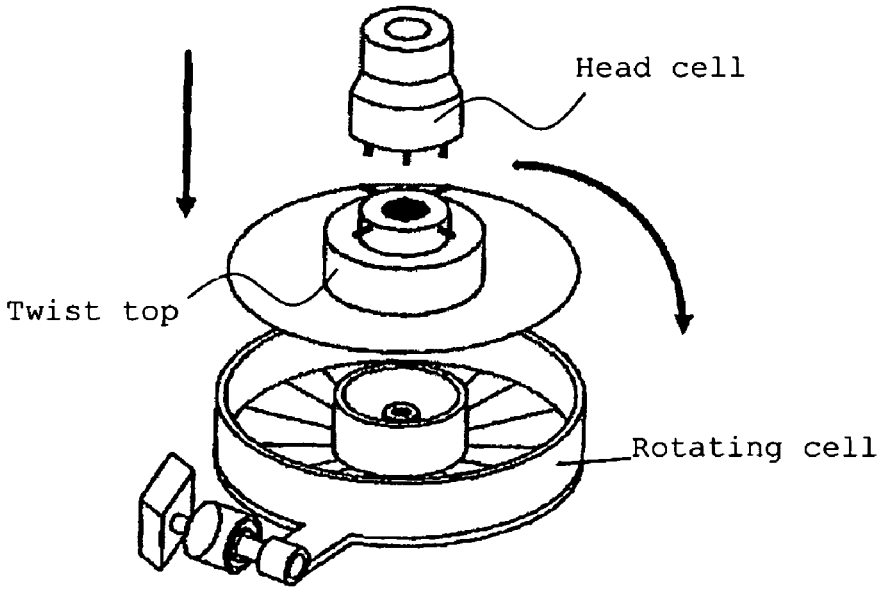
FIG. 4 is a view schematically showing a shear stress measuring device.

A rotating cell having an outside diameter of 110 mm was filled with a sample up to about 80% of the height of the cell (see FIG. 4), and a weight of the sample was weighed. After a twist top was mounted on the top of the rotating cell, a measurement (a full automatic stationary rotation test) was performed.

Firstly, a sample (powder) was pressed so as to reach a set vertical load (it may be also referred to as a consolidation load or a preset load). When reaching the consolidation load, a twist top started rotating. By the rotation, stress was applied to the sample in direction of shear. The rotation was continued until the powder layer reached a steady state, which is a limit state that a powder layer starts flowing when a vertical load is passed, that is, until a shear stress presents a maximum value.

Next, after releasing the cell from the above-mentioned vertical load, maximum values of shear stress was measured with several vertical loads, which were all below the above-mentioned preset vertical load, following the above-mentioned procedure of pressing and applying stress in the direction of shear. Upon measuring with the plural kinds of vertical load, a 75% vertical load of a former measurement was applied to a latter measurement and as a result, 7 maximum values of shear stress were measured.

From measured results, a primary line (that is, a failure envelope, see FIG. 1) is obtained taking the shear stress on the y-axis and the vertical load on the x-axis. A gradient "ϕ" of the primary line is referred to as an internal frictional angle. The above measurement was performed using 3 loads (3, 6 and 9 kPa). An average number of 3 internal frictional angles obtained from the measurement results of the loads was referred to as an internal frictional angle of the evaluation herein.

2. Uniaxial Collapsing Stress

The failure envelope of each load was obtained in the same manner as the measuring method of the internal frictional angle in "1. Internal frictional angle" and a maximum consolidation stress and a uniaxial collapsing stress of each load were calculated by Formula (1) and Formula (2) respectively as shown below. A primary line (see FIG. 2) was drawn by plotting the calculated value of each load on a graph taking the uniaxial collapsing stress on the y-axis and the maximum consolidation stress on the x-axis. The uniaxial collapsing stress when the maximum consolidation stress is 0 was referred to as a uniaxial collapsing stress of the evaluation herein. Meanwhile, the cohesion "c" in the formula means a shear stress when the vertical load is 0 in the failure envelope of in the graph.

$$\text{uniaxial collapsing stress} = \frac{2c(1+\sin\phi)}{\cos\phi} \tag{1}$$

$$\begin{matrix}\text{maximum}\\ \text{consolidation}\\ \text{stress}\end{matrix} = \left(\frac{A-\sqrt{A^2\sin^2\phi-\tau_{ssp}^2\cos^2\phi}}{\cos^2\phi}\right)(1+\sin\phi)-\left(\frac{c}{\tan\phi}\right) \tag{2}$$

$A=\sigma_{ssp}+(c/\tan\phi)$ c=cohesion(kPa) ϕ=internal frictional angle (°)

$\tau_{ssp}$=shear stress required to obtain stationary state point (kPa)

$\sigma_{ssp}$=vertical load required to obtain stationary state point (kPa)

3. Measurement of Volume Average Particle Diameter

The particle size distribution and the volume average particle diameter of the toner were measured by means of a particle diameter distribution measuring device (product name: Multicizer; manufactured by Beckman Coulter, Inc.) under the condition of an aperture diameter of 100 μm, a media of Isotone II, a density of 10% and a measured number of particles of 100,000.

4. Average Circularity

In a container preliminarily filled with a toner of 0.02 g, 0.02 g of a surfactant (alkylbenzene sulfonate) was charged as a dispersing agent. An ion-exchanged water of 10 ml was charged therein followed by a dispersion treatment by means of an ultrasonic disperser at 60 W for 3 minutes. After adjusting a concentration of the colored particle to be 3,000 to 10,000 particles/μL upon measurement, 1,000 to 10,000 colored particles having a diameter of an equivalent circle of 1 μm were measured by means of a flow particle image analyzer (product name: FPIA-2100; manufactured by Sysmex Co.). An average circularity was calculated on the basis of the measured values. Circularity can be calculated by the following formula, and the average circularity is an average value of the circularity.

Circularity=a perimeter of a circle having the same area as a projected area of a particle/a perimeter of a projected particle image 5. Shape Factor of Toner SF1 and SF2

Shape factors SF 1 and SF 2 of a toner were obtained as follows. After randomly sampling 100 images of the toner by means of a field emission scanning electron microscope FE-SEM (product name: S-800; manufactured by Hitachi, Ltd.), thus obtained image data of the toner were delivered to an image analyzer (product name: Luzex3; manufactured by Nireco Corporation) via an interface and analyzed. The shape factors SF1 and SF2 were calculated by the following formula.

Definitional Formula of SF 1:

$$\text{shape factor } (SF\ 1) = \frac{(MXLNG)^2}{\text{AREA}} \times \frac{\pi}{4} \times 100$$

wherein, MXLNG is an absolute maximum length of a toner in an image; and AREA is a projected area of the toner.

Definitional Formula of SF 2:

$$\text{shape factor } (SF\ 2) = \frac{(PELI)^2}{\text{AREA}} \times \frac{1}{4\pi} \times 100$$

wherein, PELI means a perimeter of a projected image of a toner in an image; and AREA means a projected area of the toner.

6. Absolute Value of Charge Amount |Q/M| of Toner

A carrier of 69.7 g (product name: TEFV150/250; manufactured by: Powdertech Corporation) and 0.3 g of the toner were charged in a pot (manufactured by SUS) having a capacity of 200 cc. After rotating at 150 rpm for 30 minutes, blowing off was performed with a pressure of nitrogen gas of 1 kg/cm$^2$ by means of a blowoff charge measuring instrument (manufactured by Toshiba Chemical Corporation). Thereby, an absolute value of a charge amount of the toner was measured.

7. Number Average Primary Particle Diameter of External Additive

The number average primary particle diameter of the external additive is obtained in the following manner. External additive particles were photographed by means of an electron microscope. From thus obtained microgram, a diameter of an equivalent circle having the same area as a projected area of each external additive particle was calculated under the condition that a maximum area ratio of a particle with respect to a frame area is 2%, and a total process number of particle is 100 by means of an image analyzer (product name: LUZEX IID; manufactured by Nireco Corporation). An average value was calculated from the obtained results.

8. Hydrophobicity of External Additive

The hydrophobicity was obtained according to the methanol method mentioned below. 0.2 g of the external additive to be measured was charged in a 500 ml beaker and added with 50 ml of pure water. While stirring with a magnetic stirrer, methanol was added under a liquid surface. When no sample (external additive particle) is visually observed on the liquid surface is referred to as an end point, the hydrophobicity is calculated by the following formula:

$$\text{hydrophobicity } (\%) = (X/(50+X)) \times 100$$

wherein, X: amount (ml) of methanol used.

9. Evaluation of Initial Printing Density

A toner for evaluation was charged into a development device of a commercially available printer (printing speed: 20 prints per minute) of a non-magnetic one-component developing method. After leaving the printer under the N/N environment or the H/H environment for one day (24 hours), continuous printing was performed with 5% printing density from the early phase. After plain pattern printing of the tenth page was performed, an initial printing density under the N/N environment or the H/H environment was measured by means of a McBeth reflection image densitometer. It is generally preferable that initial printing density is in the range of 1.35 to 1.45.

10. Evaluation of Reproductivity of Thin Line

In the same manner as the above, a toner for evaluation was charged in the development device of the printer and left under the N/N environment for one day (24 hours). 10,000 prints of line image were continuously printed with 2×2 dot line (having a width of about 85 μm; 600 dpi). A rate of the surface of a photosensitive member at which a cleaning blade was contacting was 12 cm/sec.

Density distribution data of the line image were obtained per 500 prints by means of a printing evaluation system (product name: RT2000; manufactured by YA-MA Ltd.). A whole width of a line image at a density having a half value of a maximum density in the density distribution data was considered as a line width. Based on the width of the line of a line image printed on the first print, a print with a line width having difference of 10 μm or less was considered to be a reproduction of the line image of the first print. Number of prints maintaining the difference of the line width of 10 μm or less, which is a thin line, was searched. Toners were classified into 3 categories as follows. If the number of prints maintaining the thin line was 10,000 or more, the toner used for the printing was classified as "o". If the number of prints maintaining the thin line was less than 5,000, the toner was classified as "x". Finally, if the number of prints maintaining the thin line was 5,000 or more and less than 10,000, the toner was classified as "Δ".

10. Initial Charge Speed (Solid Pattern Following Capability)

In the same manner as the above, a toner for evaluation was charged into the developing apparatus of the printer and left under the N/N environment for one day (24 hours). Continuous printing was performed with 5% printing density from the early phase. Solid pattern printing was performed on the 10th print, and each image density of portions 50 mm away from leading and rear ends of the printed solid pattern was measured by means of the McBeth reflection image densitometer. The toners were classified into 3 categories as follows. If the difference between the image density of the leading end portion and that of the rear end portion was less than 0.2, the toner used for the printing was classified as "o". If the difference between the image density of the leading end portion and that of the rear end portion was 0.2 or more and less than 0.4, the toner used for the printing was classified as "Δ". If the difference between the image density of the leading end portion and that of the rear end portion was 0.4 or more, the toner used for the printing was classified as "x".

11. Evaluation of Cleaning Performance

In the same manner as the above, a toner for evaluation was charged into the developing apparatus of the printer and left under the L/L environment for one day (24 hours). Continuous half tone printing was performed with 5% printing density, and 10,000 prints were printed. The rate of the surface of the photosensitive member at which the cleaning blade was contacting was 12 cm/sec. The surface of a charging roller was visually observed every 500 prints. The toners were classified into 3 categories as follows. If it was confirmed that a toner which passed through the cleaning blade and remained on the surface of the charging roller when 5,000 prints were printed, the toner was classified as "x" meaning defective cleaning. If it was confirmed that the toner remained was attached on the surface of the charging roller when 5,500 or more and less than 10,000 prints were printed, the toner was classified as "Δ". If it was confirmed that the toner remained was attached on the surface of the charging roller when 10,000 prints were printed, the toner was classified as "o".

Results

The results are shown in Tables 1-1 and 1-2.

TABLE 1

| | | | Example 1 | Comparative Example 1 | Comparative Example 2 | Comparative Example 3 |
|---|---|---|---|---|---|---|
| Toner property | Uniaxial collapsing stress (kPa) | | 1.26 | 0.04 | 1.32 | 0.98 |
| | Internal frictional angle (°) | | 36.7 | 27.0 | 21.5 | 48.1 |
| | Volume average particle diameter (μm) | | 6.7 | 9.5 | 9.8 | 6.4 |
| | Average circularity | | 0.962 | 0.982 | 0.986 | 0.985 |
| | Shape factor | SF 1 | 135 | 111 | 111 | 111 |
| | | SF 2 | 115 | 115 | 114 | 111 |
| | Charge amount \|Q/M\| (μC/g) | | 95 | 45 | 70 | 55 |
| External additive | Average primary particle diameter (nm) | Particle (A) | 12 (0.7 parts) | 12 (0.7 parts) | 12 (0.5 parts) | 12 (0.5 parts) |
| | | Particle (B) | 15 (0.3 parts) | — | — | 40 (2.0 parts) |
| | | Particle (C) | 150 (0.1 parts) | 400 (0.3 parts) | — | — |
| | Hydrophobicity (%) | Particle (A) | 80 | 65 | 65 | 65 |
| | | Particle (B) | 70 | — | — | 64 |
| Evaluation Result | Initial printing density | N/H | 1.44 | 1.32 | 1.45 | 1.30 |
| | | H/H | 1.40 | 1.31 | 1.41 | 1.10 |
| | Initial charge speed | N/N | ○ | Δ | ○ | X |
| | Reproductivity of thin line | N/N | ○ | ○ | Δ | ○ |
| | Cleaning performance | L/L | ○ | X | X | X |

| | | | Comparative Example 4 | Comparative Example 5 | Comparative Example 6 | Comparative Example 7 |
|---|---|---|---|---|---|---|
| Toner property | Uniaxial collapsing stress (kPa) | | 1.70 | 0.30 | 1.60 | 0.80 |
| | Internal frictional angle (°) | | 42.0 | 43.0 | 45.0 | 53.0 |
| | Volume average particle diameter (μm) | | 8.3 | 6.7 | 6.9 | 6.5 |
| | Average circularity | | 0.938 | 0.963 | 0.965 | 0.961 |
| | Shape factor | SF 1 | 125 | 120 | 122 | 126 |
| | | SF 2 | 145 | 121 | 131 | 135 |
| | Charge amount \|Q/M\| (μC/g) | | 80 | 35 | 10 | 45 |
| External additive | Average primary particle diameter (nm) | Particle (A) | 12 (0.7 parts) | 12 (1.0 parts) | 12 (0.7 parts) | 12 (1.0 parts) |
| | | Particle (B) | — | — | 20 (0.3 parts) | 25 (0.5 parts) |
| | | Particle (C) | — | 350 (5.5 parts) | 150 (0.1 parts) | 4000 (0.25 parts) |
| | Hydrophobicity (%) | Particle (A) | 65 | 80 | 35 | 80 |
| | | Particle (B) | — | — | 30 | 70 |
| Evaluation Result | Initial printing density | N/H | 1.30 | 1.10 | 0.8 | 1.35 |
| | | H/H | 1.25 | 0.90 | 0.72 | 0.55 |
| | Initial charge speed | N/N | Δ | X | Δ | X |
| | Reproductivity of thin line | N/N | X | X | X | Δ |
| | Cleaning performance | L/L | ○ | ○ | ○ | ○ |

Summary of Results

In comparison with Comparative examples 1 to 7, the toner of Example 1 was excellent in all evaluations including the initial charge speed under the N/N environment, the reproductivity of thin lines under the N/N environment and the cleaning performance under the L/L environment.

To the contrary, in the cases of the toners of Comparative examples 1 and 2, the internal frictional angles of which were smaller than the specified range of the present invention, cleaning trouble occurred when 5,000 prints were printed since each of the toners was spherical and flowability was too high.

In the cases of the toners of Comparative examples 3 and 7, the internal frictional angles of which were above the specified range of the present invention, the initial charge speed of each toner was not good due to poor flowability of each toner. Since the toner of Comparative example 3 was spherical, cleaning trouble was also observed.

In the case of the toner of Comparative example 4 which was produced by the pulverizing method, particularly reproductivity of thin lines deteriorated since cohesion of the toner was strong and the average circularity was less than the specified range of the present invention.

In the case of the toner of Comparative example 5, the uniaxial collapsing stress of which was less than the specified range of the present invention, the initial charge speed was poor since cohesion of the toner was low.

In the case of the toner of Comparative example 6, the uniaxial collapsing stress of which was above the specified range of the present invention, particularly reproductivity of thin lines deteriorated since cohesion of the toner was rather strong and the charge amount of the toner was too low.

While the initial printing density of the toner of Example 1 was within the preferable range under the N/N and H/H environments, the toners of Comparative examples 1 to 7 were not able to achieve the preferable initial printing density under any environments.

What is claimed is:

1. A toner for developing electrostatic image comprising a colored particle containing a binder resin and a colorant, and an external additive, wherein the toner for developing electrostatic image has a volume average particle diameter of 4.0 to 8.0 μm and an average circularity of 0.940 to 0.980, wherein the external additive includes an inorganic microparticle (A) having a small particle diameter with a number average primary particle diameter of from 5 to 14 nm, an inorganic microparticle (B) having a medium particle diameter with a number average primary particle diameter of from 15 to 90 nm, and a particle (C) having a large particle diameter with a number average primary particle diameter of from 100 to 500 nm, wherein a hydrophobicity measured by a methanol method of the inorganic microparticle (A) having a small particle diameter and/or the inorganic microparticle (B) having a medium particle diameter is from 50 to 100%, wherein an added amount of the external additive is from 0.01 to 3 parts by weight with respect to 100 parts by weight of the colored particle, and wherein the toner for developing electrostatic image has a uniaxial collapsing stress of 0.8 to 1.5 kPa and an internal frictional angle of 30 to 45° when a maximum consolidation stress is 0.

2. A toner for developing electrostatic image according to claim 1, wherein an absolute value of a charge amount |Q/M| of the toner for developing electrostatic image is from 30 to 120 μC/g.

3. A toner for developing electrostatic image according to claim 1, wherein the inorganic microparticle (A) having a small particle diameter is a particle of silica.

4. A toner for developing electrostatic image according to claim 3, wherein the inorganic microparticle (B) having a medium particle diameter is a particle of silica or a particle of titanium oxide, and the particle (C) having a large particle diameter is an organic resin particle.

5. A toner for developing electrostatic image according to claim 1, wherein the colored particle is produced by polymerizing a polymerizable monomer composition containing a polymerizable monomer and a colorant in an aqueous dispersion medium containing a dispersion stabilizer.

6. A toner for developing electrostatic image according to claim 1, wherein the colored particle is obtained by:

producing a particle by polymerizing a polymerizable monomer composition containing a polymerizable monomer and a colorant in an aqueous dispersion medium containing a dispersion stabilizer to form a core layer; and forming a shell layer by covering the core layer with a substance having a higher softening point than the core layer.

7. A toner for developing electrostatic image according to claim 1, wherein the colored particle contains a charge control agent.

8. A toner for developing electrostatic image according to claim 7, wherein the charge control agent is a charge control resin.

9. A toner for developing electrostatic image according to claim 1, wherein the toner is applied to an image forming device having a cleaning blade.

* * * * *